US009863439B2

(12) United States Patent
Rosen et al.

(10) Patent No.: US 9,863,439 B2
(45) Date of Patent: Jan. 9, 2018

(54) BACKING PLATE

(71) Applicant: Hamilton Sundstrand Corporation, Windsor Locks, CT (US)

(72) Inventors: Seth E. Rosen, Middletown, CT (US); David A. Dorman, Feeding Hills, MA (US); Craig M. Beers, Wethersfield, CT (US)

(73) Assignee: Hamilton Sundstrand Corporation, Windsor Locks, CT (US)

( * ) Notice: Subject to any disclaimer, the term of this patent is extended or adjusted under 35 U.S.C. 154(b) by 492 days.

(21) Appl. No.: 14/483,571

(22) Filed: Sep. 11, 2014

(65) Prior Publication Data

US 2016/0076554 A1 Mar. 17, 2016

(51) Int. Cl.
*F04D 29/44* (2006.01)
*F04D 29/68* (2006.01)

(52) U.S. Cl.
CPC ..... *F04D 29/681* (2013.01); *F04D 29/444* (2013.01); *F05D 2240/121* (2013.01); *F05D 2250/52* (2013.01); *F05D 2270/101* (2013.01)

(58) Field of Classification Search
CPC ..... F04D 29/681; F04D 29/444; F05D 2240/121; F05D 2250/52; F05D 2270/101
USPC ..... 415/208.3, 208.2
See application file for complete search history.

(56) References Cited

U.S. PATENT DOCUMENTS 2,609,141 A * 9/1952 Aue ..... F04D 17/165 415/208.2
3,324,599 A * 6/1967 Brost ..... E06B 1/20 49/505
3,860,360 A * 1/1975 Yu ..... F04D 29/441 415/208.3
4,211,514 A * 7/1980 Hawes ..... F04D 29/441 415/142
6,017,184 A * 1/2000 Aguilar ..... F01D 25/168 415/105
6,471,475 B1 * 10/2002 Sasu ..... F04D 29/444 415/211.2
7,302,804 B2 12/2007 Murry et al.
8,162,604 B2 * 4/2012 Kuhnel ..... F01D 5/141 415/208.4
8,235,648 B2 8/2012 LeBlanc
8,328,512 B2 * 12/2012 Major ..... F01D 17/162 415/209.4
8,807,921 B2 * 8/2014 Struziak ..... F04D 29/057 29/888
8,814,639 B1 * 8/2014 Mecozzi ..... F04D 27/004 415/119
8,834,097 B2 * 9/2014 Jewess ..... F01D 9/045 415/119
8,939,718 B2 * 1/2015 Claus ..... F04D 29/444 415/186

(Continued)

*Primary Examiner* — Woody Lee, Jr.
*Assistant Examiner* — Brian Delrue
(74) *Attorney, Agent, or Firm* — Kinney & Lange, P.A.

(57) ABSTRACT

An annular backing plate for a diffuser in a centrifugal compressor comprises an inner diameter and an outer diameter disposed radially opposite the inner diameter. The backing plate also includes a first surface extending between the inner diameter and the outer diameter of the backing plate. A step is formed on the first surface proximate the inner diameter, wherein the step shifts a portion of the first surface encompassed by the step axially aft relative a portion of the first surface not encompassed by the step.

13 Claims, 5 Drawing Sheets

(56) References Cited

U.S. PATENT DOCUMENTS

| | | | | |
|---|---|---|---|---|
| 9,243,649 | B2 * | 1/2016 | Fournier | F04D 15/0027 |
| 2006/0062665 | A1 * | 3/2006 | McAuliffe | F04D 29/462 415/191 |
| 2006/0127242 | A1 * | 6/2006 | Martin | F04D 25/04 417/407 |
| 2007/0274826 | A1 * | 11/2007 | Kuhnel | F01D 5/141 415/191 |
| 2008/0276613 | A1 * | 11/2008 | Noelle | F01D 17/165 60/595 |
| 2008/0298951 | A1 * | 12/2008 | Brault | F01D 17/105 415/58.5 |
| 2009/0155058 | A1 * | 6/2009 | Noelle | F04D 29/462 415/162 |
| 2012/0011878 | A1 | 1/2012 | Hipsky | |
| 2012/0114463 | A1 | 5/2012 | Beers et al. | |
| 2013/0149132 | A1 | 6/2013 | Webster | |
| 2013/0315717 | A1 * | 11/2013 | Weule | F01D 17/165 415/149.1 |
| 2014/0026993 | A1 | 1/2014 | Rosen et al. | |
| 2014/0030070 | A1 | 1/2014 | Beers et al. | |
| 2014/0314559 | A1 * | 10/2014 | Khalitov | F04D 19/002 415/208.1 |
| 2014/0356124 | A1 * | 12/2014 | Dorman | F01D 9/04 415/1 |

* cited by examiner

BACKING PLATE

BACKGROUND

The present disclosure relates to aircraft environmental control systems. More specifically, the present disclosure relates to a diffuser backing plate of a cabin air compressor for an aircraft environmental control system.

Environmental control systems (ECSs) are utilized on various types of aircraft for several purposes, such as in cooling systems for the aircraft. For example, components of an ECS may be utilized to remove heat from various aircraft lubrication and electrical systems and/or used to condition aircraft cabin air. An ECS includes one or more cabin air compressors which compress air entering the system, from an outside source or from a ram air system. The compressed air is delivered to an environmental control system to bring it to a desired temperature and delivered to the aircraft cabin. After passing through the cabin, the air is typically exhausted to the outside. Cabin air compressors are typically centrifugal compressors comprising an impeller and a diffuser.

During operation, a cabin air compressor causes the pressure at an outlet of the cabin air compressor to be greater than that at an inlet of the cabin air compressor. Several factors affect the performance and efficiency of the cabin air compressor, such as the pressure ratio (the ratio of outlet pressure to inlet pressure for that cabin air compressor), and the mass flow through the cabin air compressor. At relatively high pressure ratios a greater mass flow is required for the cabin air compressor to function stably. If the pressure ratio is too high for the current mass flow the cabin air compressor may start to stall with a loss of even airflow. If the airflow stalls to a sufficient degree the higher pressure at the outlet of the cabin air compressor can cause reverse airflow, which is known as surge.

Surge in a cabin air compressor can result in loss of output and vibration to the cabin air compressor that could possibly damage the cabin air compressor. To avoid surge during operation, the cabin air compressor is designed to have a safety margin between the mass flow and the pressure ratio at which the cabin air compressor will normally be operated, and the mass flow and pressure ratio at which a surge will occur. Expanding the safety margin of the cabin air compressor will increase the operational range of the cabin air compressor.

SUMMARY

In one aspect of the invention, an annular backing plate for a diffuser in a centrifugal compressor comprises an inner diameter and an outer diameter disposed radially opposite the inner diameter. The backing plate also includes a first surface extending between the inner diameter and the outer diameter of the backing plate. A step is formed on the first surface proximate the inner diameter, wherein the step shifts a portion of the first surface encompassed by the step axially aft relative a portion of the first surface not encompassed by the step.

In another aspect of the invention, a cabin air compressor assembly includes a rotor section with a hub and a plurality of blades. The cabin air compressor also includes a diffuser section disposed radially outward from the rotor section. The diffuser section includes a backing plate. The backing plate includes an inner diameter disposed proximate the rotor section and an outer diameter disposed radially opposite the inner diameter. The backing plate also includes a first surface extending between the inner diameter and the outer diameter, a second surface disposed axially opposite the first surface, and a step formed on the first surface proximate the inner diameter. The diffuser section also includes a shroud disposed opposite the first surface of the backing plate and a plurality of vanes disposed between the shroud and the first surface of the backing plate. Each of the plurality of vanes extends radially between the inner diameter and the outer diameter of the backing plate.

Persons of ordinary skill in the art will recognize that other aspects and embodiments of the present invention are possible in view of the entirety of the present disclosure, including the accompanying figures.

Figure 1:
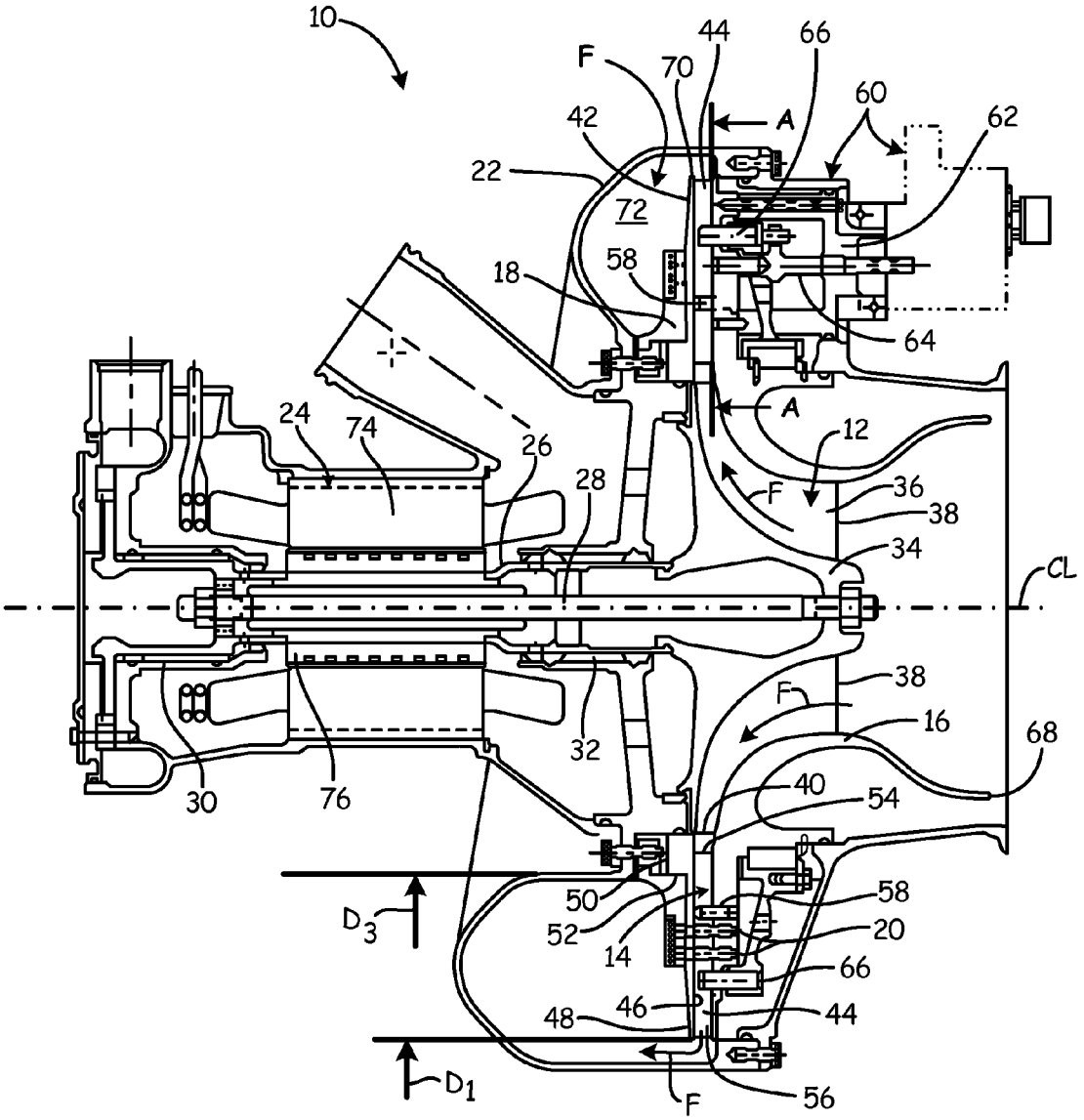
FIG. 1 is a cross-sectional view of a cabin air compressor.

While the above-identified drawing figures set forth one or more embodiments of the invention, other embodiments are also contemplated. In all cases, this disclosure presents the invention by way of representation and not limitation. It should be understood that numerous other modifications and embodiments can be devised by those skilled in the art, which fall within the scope and spirit of the principles of the invention. The figures may not be drawn to scale, and applications and embodiments of the present invention may include features and components not specifically shown in the drawings. Like reference numerals identify similar structural elements.

DETAILED DESCRIPTION

The present disclosure provides cabin air compressor with a diffuser backing plate, the diffuser backing plate having a step disposed proximate the inner diameter of the backing plate and the leading edge of the vanes. The step can reduce the likelihood of surge by allowing air in the cabin air compressor to leak into the step to reduce the pressure ratio of the cabin air compressor.

FIG. 1 is a cross-sectional view of cabin air compressor 10. The following is a list of elements that cabin air compressor 10 can include. As shown in FIG. 1, cabin air compressor assembly 10 can be a centrifugal compressor that includes rotor section 12, diffuser section 14, shroud 16, mounting plate 18, connecting bolts 20, housing 22, electric motor 24, drive shaft 26, tie rod 28, first bearing assembly 30 and second bearing assembly 32. Rotor section 12 can include hub 34 and blades 36, each of blades 36 including leading edge 38 and trailing edge 40. Diffuser section 14 includes backing plate 42 and vanes 44. Backing plate 42 can include outer diameter D1, inner diameter D2, intermediate diameter D3, first surface 46, second surface 48, third surface 50, and cylindrical surface 52. Each of vanes 44 can include leading edge 54, trailing edge 56, and pivot pins 58. Vanes 44 can be connected to actuator 60 which can include rack 62, pinion 64, and drive pins 66. Shroud 16 can include compressor inlet 68. Shroud 16 and backing plate 42 can form diffuser outlet 70. Housing 22 can form plenum 72. Electric motor 24 can include motor stator 74 and motor rotor 76. The configuration of the elements of cabin air compressor 10, as shown in FIG. 1, is discussed below.

Blades 36 and hub 34 of rotor section 12 are centered on centerline CL of cabin air compressor assembly 10 and rotate about centerline CL. Centerline CL defines an axial direction that extends forward and aft. Blades 36 are centrifugal blades that are configured to turn and direct an axially oriented fluid flow F entering rotor section 12 at leading edges 38 of blades 36 to a radially direction that extends radially outward from centerline CL. Shroud 16 can be disposed at least partially around rotor section 12 and can define compressor inlet 68 through which fluid flow F enters rotor section 12. Shroud 68 can extend generally in the axial direction at compressor inlet 68. As shroud 68 extends aft of compressor inlet 68 and leading edges 38 of blades 36, shroud 68 can turn and transition toward the radial direction and extend radial outward from centerline CL. Together, shroud 68 and hub 34 of rotor section 12 define a flow duct across rotor section 12. Shroud 68 can extend radially outward from trailing edges 40 of blades 36 into diffuser section 14.

Diffuser section 14 is disposed radially outward from rotor section 12. Backing plate 42 of diffuser section is disposed axially aft from shroud 68 and can be disposed radially outward from trailing edges 40 of blades 36. Backing plate 42 can be an annular plate such that outer diameter D1 is disposed radially opposite and outward from inner diameter D2. Inner diameter D2 can be disposed proximate trailing edges 40 of blades 36 of rotor section 12 and can define, along with shroud 16, an inlet to diffuser section 14. Shroud 16 can extend radially outward to an extent proximate outer diameter D1 such that shroud 16 and outer diameter D1 of backing plate 42 define diffuser outlet 70. First surface 46 of backing plate 42 extends between inner diameter D2 and outer diameter D1 and faces shroud 16 such that shroud 16 is disposed opposite first surface 46 of backing plate 42 and axially forward of first surface 46 of backing plate 42.

Vanes 44 can be disposed between shroud 16 and first surface 46 of backing plate 42. Each one of vanes 44 can extend radially between inner diameter D2 and outer diameter D1 of backing plate 42 such that leading edges 54 of vanes 44 are disposed proximate inner diameter D2 of backing plate 42 and trailing edges 56 of vanes 44 are disposed proximate outer diameter D1 of backing plate 42. Vanes 44 can be variable vanes, with each of vanes 44 comprising pivot pin 58 about which each vane 44 can rotate. Actuator 60 can be connected to shroud 16 and configured to actuate vanes 44. Actuator 60 can actuate vanes 44 by rotating pinion 64. Pinion 64 is meshed with rack 62 and causes rack 62 to translate. Drive pins 66 can be connected to rack 62 and can extend across shroud 16 to engage vanes 44. As pinion 64 translates rack 62, drive pins 66 engage vanes 44 and cause vanes 44 to move about pivot pins 58.

Mounting plate 18 can be disposed axially aft of backing plate 42 and can be connected to second surface 48 of backing plate 42. Second surface 48 of backing plate 42 can be disposed axially aft of first surface 46 and can extend radially inward from outer diameter D1. Third surface 50 of backing plate 42 can be disposed axially aft of both first surface 46 and second surface 48. Third surface 50 extends radially from inner diameter D2 to intermediate diameter D3. Intermediate diameter D3 can be positioned radially between inner diameter D2 and outer diameter D1. Cylindrical surface 52 can extend axially from third surface 50 at intermediate diameter D3 toward second surface 48. Cylindrical surface 52 can contact backing plate 42 such that cylindrical surface 52 supports and radially positions mounting plate 18 relative centerline CL. Connecting bolts 20 can extend axially from mounting plate 18 to shroud 16 to connect mounting plate 18 to shroud 16 such that backing plate 42 and vanes 44 are secured axially between shroud 16 and mounting plate 18.

Housing 22 is disposed proximate outer diameter D1 of backing plate 42 and forms plenum 72. Diffuser outlet 70 fluidically communicates with plenum 72 such that fluid flow F exiting diffuser section 14 enters plenum 72. Plenum 72 directs fluid flow F toward an outlet (not shown) of cabin air compressor assembly 10.

As shown in FIG. 1, tie rod 28 can connect hub 34 of rotor section 12 to drive shaft 26 and motor rotor 76 of electric motor 24. Drive shaft 26 and motor rotor 76 are supported by first bearing assembly 30 and second bearing assembly 32. Motor stator 74 is disposed around motor rotor 76. During operation of cabin air compressor assembly 10, motor stator 74 is electrically energized, thereby causing motor rotor 76 to rotate. Because tie rod 28 connects drive shaft 26 and hub 34 of rotor section 12 to motor rotor 76, drive shaft 26 and hub 34 also rotate as motor rotor 76 rotates. As hub 34 and blades 36 of rotor section 12 rotate, fluid flow F, which can be air, enters compressor inlet 68, and flows across leading edges 38 and trailing edges 40 of blades 36 of rotor section 12. As fluid flow F traverses rotor section 12, fluid flow F is compressed and directed radially outward toward diffuser section 14. Fluid flow F then enters diffuser section 14 between backing plate 42 and shroud 16 and flows radially outward across leading edges 54 and trailing edges 56 of vanes 44. As fluid flow F traverses vanes 44, actuator 60 can adjust the position of vanes 44 to condition fluid flow F. After traversing diffuser section 14, fluid flow F enters plenum 72 and then exits cabin air compressor assembly through the outlet (not shown) of cabin air compressor assembly 10. As discussed below with reference to FIGS. 2A-2B, backing plate 42 can include step 78 to reduce the likelihood of surge occurring in cabin air compressor assembly 10.

Figure 2A:
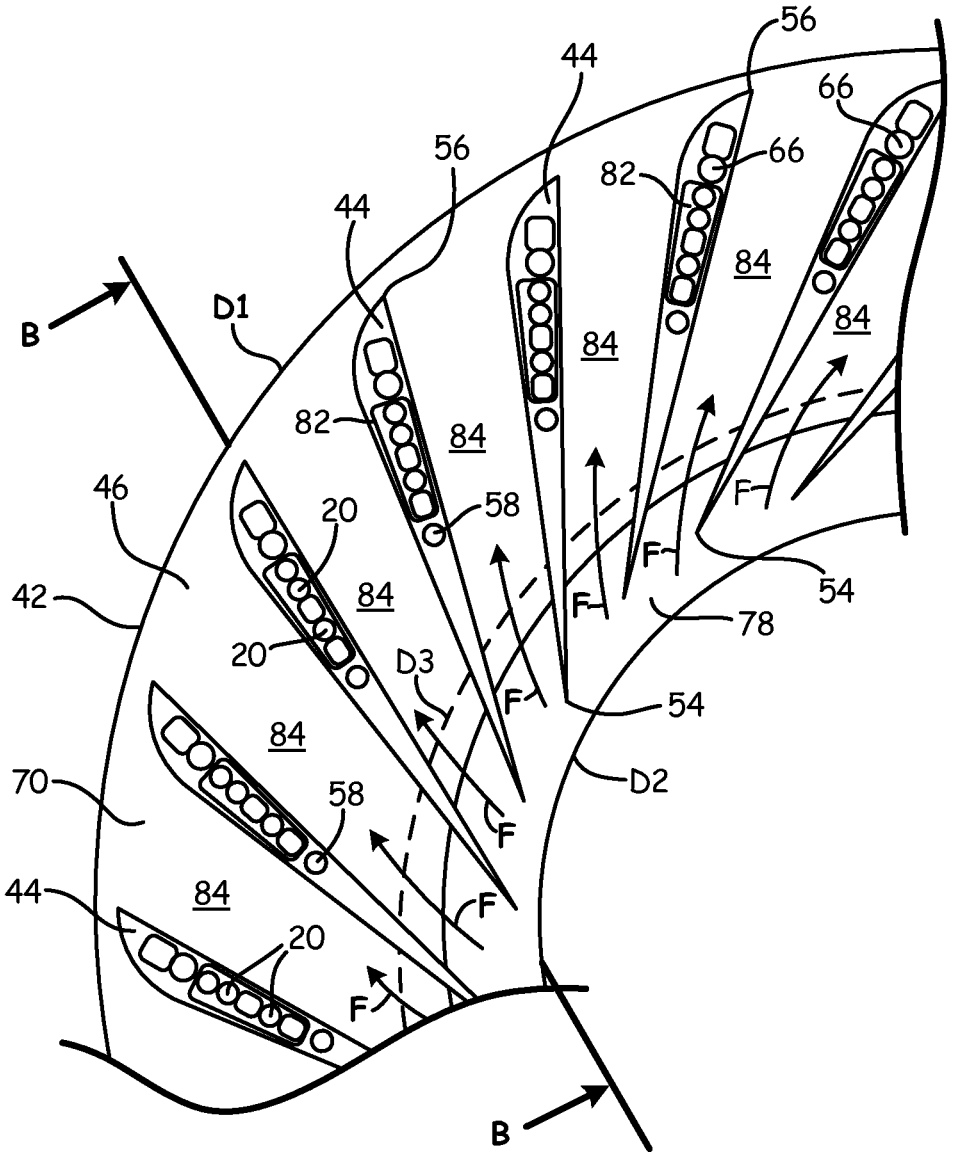
FIG. 2A is a quarter section view of a backing plate and plurality of vanes of the cabin air compressor of FIG. 1 taken along line A-A.
Figure 2B:
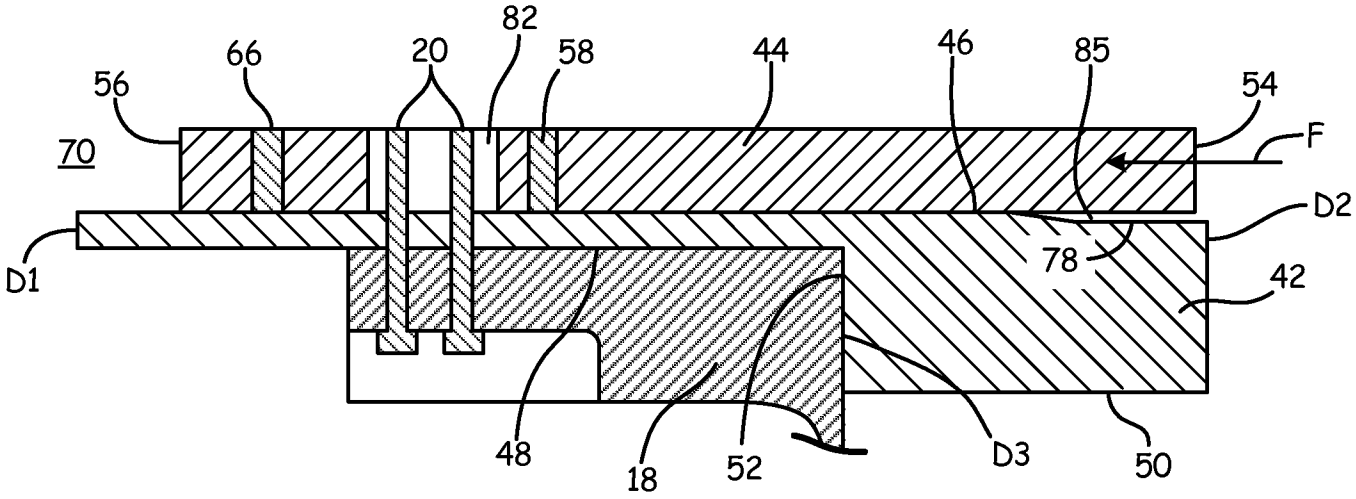
FIG. 2B is a cross-sectional view of the backing plate and one of the plurality of vanes of FIG. 2A taken along line B-B.

In FIGS. 2A and 2B, components and elements of like numbering with the components and elements of FIG. 1 are assembled as discussed above with reference to FIG. 1. FIG. 2A is a quarter section view of cabin air compressor 10 of FIG. 1 taken along line A-A, showing backing plate 42 and vanes 44. FIG. 2B is a cross-sectional view of backing plate 42, vanes 44, and mounting plate 18 of FIG. 2A taken along line B-B. In addition to the components and elements describe above with reference to FIG. 1, backing plate 42 can also include step 78 and vanes 44 can each include internal cavity 82. Vanes 44 can also form flow passages 84. Step 78 and vanes 44 can form gap 85.

As shown in FIG. 2, and also described above with reference to FIG. 1, vanes 44 can be variable vanes that move on first surface 46 about pivot pins 58. To reinforce first surface 46 against wear that might occur between vanes 44 and first surface 46, first surface 46 of backing plate 42 can include a hard anodizing coating. Internal cavity 82 can be formed in each of vanes 44 to accommodate connecting bolts 20 or any other hardware that may need to axially traverse diffuser section 14 without interrupting flow passages 84.

Step 78 is formed on first surface 46 proximate inner diameter D2 of backing plate 42. Step 78 can extend radially on first surface 46 between inner diameter D2 and intermediate diameter D3 (shown in phantom). Step 78 can also extend circumferentially around inner diameter D2 of backing plate 42. Step 78 is a step-down in first surface 46 from outer diameter D1 to inner diameter D2. Because step 78 is a step-down in first surface 46, the portion of first surface 46 encompassed by step 78 is shifted axially aft relative the portion of first surface 46 not encompassed by step 78. Because the portion of first surface 46 encompassed by step 78 is shifted axially aft, step 78 increases the space and flow area between first surface 46 of backing plate 42 and shroud 16 at step 78. Backing plate 42 with step 78 can be installed in diffuser section 14 of cabin air compressor 10 when cabin air compressor 10 is initially manufactured, or backing plate 42 with step 78 can be retrofitted into cabin air compressor 10 during the service life of cabin air compressor 10.

During operation, as fluid flow F exits rotor section 12 and enters diffuser section 14, at least a portion of fluid flow F can expand into the increased flow area provided by step 78 and thereby decrease the pressure of fluid flow F entering flow passages 84 of diffuser section 14. Decreasing the pressure of fluid flow F as it enters diffuser section 14 causes the pressure ratio across cabin air compressor assembly 10 to decrease, thereby reducing the likelihood of fluid flow F stalling inside diffuser section 14 and causing cabin air compressor assembly 10 to surge. Step 78 also aids diffuser section 14 in absorbing flow irregularities that may form in the boundary layers of fluid flow F as fluid flow F exits rotor section 12 and enters diffuser section 14. Absorbing and reducing flow irregularities in fluid flow F is significant because the presence of flow irregularities in fluid flow F can possibly cause fluid flow F to detach from vanes 44 and cause fluid flow F to stall, resulting in a surge in cabin air compressor assembly 10.

As shown in FIGS. 2A-2B, vanes 44 can extend over step 78 such that step 78 can extend underneath a portion of each of vanes 44 to create gap 85 between first surface 46 of backing plate 42 and the portion of each of vanes 44 proximate leading edges 54 of vanes 44. Because step 78 extends underneath the portion of each of vanes 44 proximate leading edges 54, the portion of fluid flow F that expands into step 78 during operation can travel in step 78 between vanes 44 and flow passages 84. Allowing the portion of fluid flow F in step 78 to travel between vanes 44 and flow passages 84 can aid in equalizing the pressure of fluid flow F in flow passages 84 and reducing irregularities that may exist in fluid flow F between different flow passages 84. As discussed below with reference to FIGS. 3 and 4, step 78 is uniquely designed to be relatively small in size compared to the other dimensions of backing plate 42 so as to impart the above described benefits of step 78 without hindering the performance of cabin air compressor assembly 10.

Figure 3:
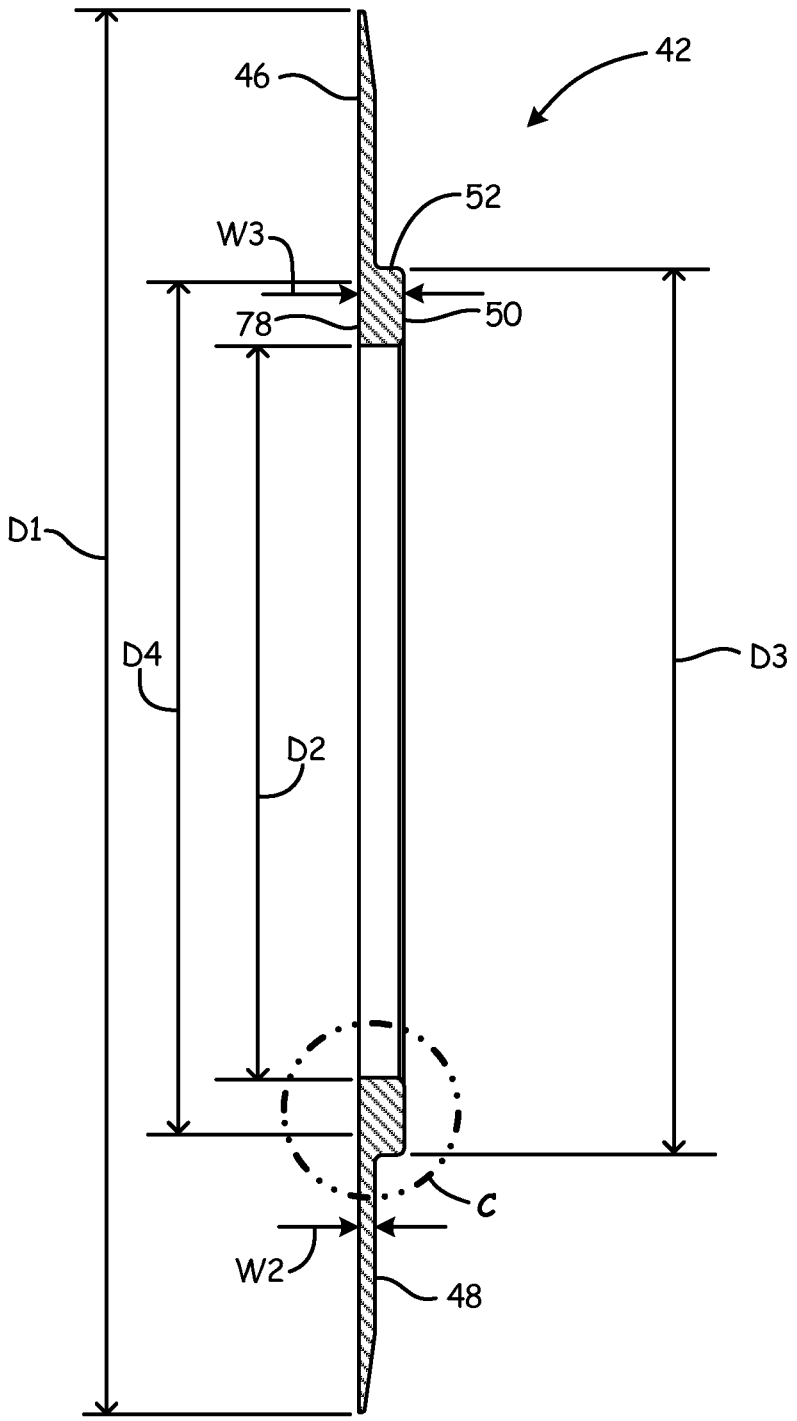
FIG. 3 is a cross-sectional view of the backing plate from the cabin air compressor of FIG. 1.
Figure 4:
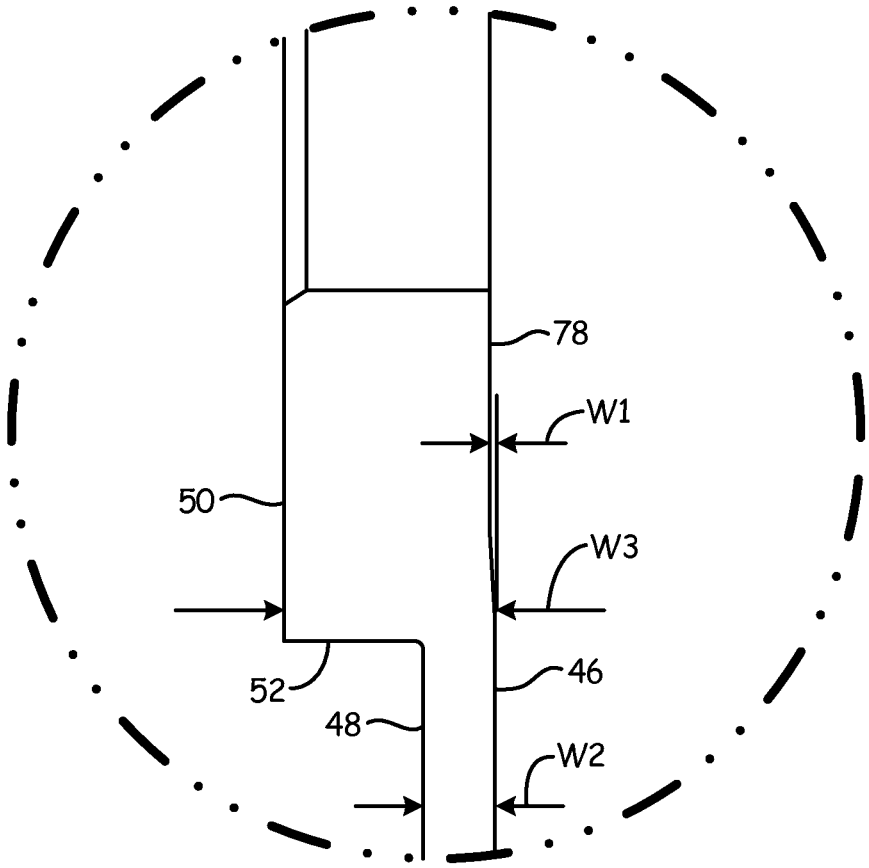
FIG. 4 is an enlarged cross-sectional view of the backing plate from FIG. 3 taken from circle C.

FIGS. 3-4 will be discussed concurrently. FIG. 3 is a cross-sectional view of backing plate 42 from cabin air compressor 10 of FIG. 1, and FIG. 4 is an enlarged cross-sectional view of backing plate 42 of FIG. 3 taken from circle C. As shown in FIGS. 3-4, step 78 can include depth W1, diameter D4, and transition section 80 (all shown in FIG. 4). Backing plate can include width W2 between first surface 46 and second surface 48, and width W3 between first surface 46 and third surface 50.

As shown in FIG. 4, depth W1 of step 78 defines the distance that step 78 causes first surface 46 to step down. Depth W1 of step 78 is relatively small compared to width W2 and width W3 of backing plate 42. A ratio (W1/W2) between depth W1 of step 78 and width W2 between first surface 46 and second surface 48 can be approximately 0.020 to 0.032. A ratio (W3/W1) between width W3 between first surface 46 and third surface 50 and depth W1 of step 78 can be approximately 93.333 to 142.500. A ratio (W3/W2) between width W3 between first surface 46 and third surface 50 and width W2 between first surface 46 and the second surface 48 can be approximately 2.8 to 3.0.

Diameter D4 of step 78 is larger than inner diameter D2 of backing plate 42, yet diameter D4 is smaller than outer diameter D1 and can also be smaller than intermediate diameter D3. A ratio between the length of inner diameter D2 and a diameter D4 of step 78 can be approximately 0.8449 to 0.8454. A ratio between a length of outer diameter D1 and a length of inner diameter D2 can be approximately 1.898 to 1.899. A ratio between the length of outer diameter D1 and a length of intermediate diameter D3 can be approximately 1.584 to 1.586. A ratio between the length of inner diameter D2 and the length of intermediate diameter D3 can be approximately 0.8346 to 0.8352.

As shown in FIG. 4, step 78 can include transition section 80 that creates a smooth, sloping surface between the portion of first surface 46 encompassed by step 78 and the remaining portion of first surface 46 not encompassed by step 78. Because of the sloping nature of transition section 80, fluid flow F can flow out of step 78 smoothly as fluid flow F travels radially outward from step 78.

In view of the foregoing description, it will be recognized that the present disclosure provides numerous advantages and benefits. For example, the present disclosure provides backing plate 42 for diffuser section 14 of cabin air compressor assembly 10. Backing plate 42 includes step 78 that decreases the pressure of fluid flow F as it enters diffuser section 14, causing the pressure ratio across cabin air compressor assembly 10 to decrease, thereby reducing the likelihood that fluid flow F will stall inside diffuser section 14 and cause cabin air compressor assembly 10 to surge. Step 78 also aids diffuser section 14 in absorbing flow irregularities that may form in the boundary layers of fluid flow F as fluid flow F exits rotor section 12 and enters diffuser section 14. Absorbing and reducing flow irregularities in fluid flow F is significant because the presence of flow irregularities in fluid flow F can possibly cause fluid flow F to detach from vanes 44 and cause fluid flow F to stall, resulting in a surge in cabin air compressor assembly 10.

The following are non-exclusive descriptions of possible embodiments of the present invention.

In one embodiment, an annular backing plate for a diffuser in a centrifugal compressor comprises an inner diameter and an outer diameter disposed radially opposite the inner diameter. The backing plate also includes a first surface extending between the inner diameter and the outer diameter of the backing plate. A step is formed on the first surface proximate the inner diameter, wherein the step shifts a portion of the first surface encompassed by the step axially aft relative a portion of the first surface not encompassed by the step.

The annular backing plate of the preceding paragraph can optionally include, additionally and/or alternatively, any one or more of the following features, configurations and/or additional components:

the step is a step-down in the first surface from the outer diameter to the inner diameter;

the backing plate further comprising: a second surface disposed axially aft of the first surface; a third surface disposed axially aft of the first and second surfaces, wherein the third surface extends radially from the inner diameter to an intermediate diameter positioned radially between the inner diameter and the outer diameter; and a cylindrical surface extending axially from the third surface at the intermediate diameter toward the second surface;

the step extends radially on the first surface between the inner diameter and the intermediate diameter;

the step extends circumferentially around the inner diameter of the backing plate;

a ratio between a depth (W1) of the step and a width (W2) between the first surface and the second surface is approximately 0.020 to 0.032;

a ratio between a width (W3) between the first surface and the third surface and the width (W2) between the first surface and the second surface is approximately 2.8 to 3.0;

a ratio between the width (W3) between the first surface and the third surface and the depth (W1) of the step is approximately 93.333 to 142.500;

a ratio between a length (D1) of the outer diameter and a length (D2) of the inner diameter is approximately 1.898 to 1.899;

a ratio between the length (D1) of the outer diameter and a length (D3) of the intermediate diameter is approximately 1.584 to 1.586;

a ratio between the length (D2) of the inner diameter and the length (D3) of the intermediate diameter is approximately 0.8346 to 0.8352; and/or a ratio between the length (D2) of the inner diameter and a diameter (D4) of the step is approximately 0.8449 to 0.8454.

In another embodiment, a cabin air compressor assembly includes a rotor section with a hub and a plurality of blades. The cabin air compressor also includes a diffuser section disposed radially outward from the rotor section. The diffuser section includes a backing plate. The backing plate includes an inner diameter disposed proximate the rotor section and an outer diameter disposed radially opposite the inner diameter. The backing plate also includes a first surface extending between the inner diameter and the outer diameter, a second surface disposed axially opposite the first surface, and a step formed on the first surface proximate the inner diameter. The diffuser section also includes a shroud disposed opposite the first surface of the backing plate and a plurality of vanes disposed between the shroud and the first surface of the backing plate. Each of the plurality of vanes extends radially between the inner diameter and the outer diameter of the backing plate.

The cabin air compressor assembly of the preceding paragraph can optionally include, additionally and/or alternatively, any one or more of the following features, configurations and/or additional components:

the step extends underneath a portion of each of the plurality of vanes such that a gap exists between the first surface of the backing plate and a portion of each of the vanes proximate a leading edge of each of the vanes; and/or the first surface of the backing plate comprises a hard anodizing coating.

Any relative terms or terms of degree used herein, such as "substantially", "essentially", "generally" and the like, should be interpreted in accordance with and subject to any applicable definitions or limits expressly stated herein. In all instances, any relative terms or terms of degree used herein should be interpreted to broadly encompass any relevant disclosed embodiments as well as such ranges or variations as would be understood by a person of ordinary skill in the art in view of the entirety of the present disclosure, such as to encompass ordinary manufacturing tolerance variations, incidental alignment variations, transitory vibrations and sway movements, temporary alignment or shape variations induced by operational conditions, and the like.

While the invention has been described with reference to an exemplary embodiment(s), it will be understood by those skilled in the art that various changes may be made and equivalents may be substituted for elements thereof without departing from the scope of the invention. For example, while the specification describes vanes 44 as being variable vanes, vanes 44 can also be stationary vanes. In another example, while the specification describes step 78 as extending circumferentially and continuously around inner diameter D2 of backing plate 42, step 78 can include a plurality of steps arrayed circumferentially around inner diameter D2 and spaced circumferentially from each other. Furthermore, while the invention has been described in reference to cabin air compressors, the invention may be used in any application where a centrifugal compressor may be required. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A cabin air compressor assembly comprising:

a rotor section comprising a hub and a plurality of blades; and a diffuser section disposed radially outward from the rotor section, wherein the diffuser section comprises:

a backing plate comprising:

an inner diameter disposed proximate the rotor section;

an outer diameter disposed radially opposite the inner diameter;

a first surface extending between the inner diameter and the outer diameter;

a second surface disposed axially opposite the first surface and aft of the first surface; and a step formed on the first surface proximate the inner diameter;

a shroud disposed opposite the first surface of the backing plate; and a plurality of vanes disposed between the shroud and the first surface of the backing plate, wherein each of the plurality of vanes is in contact with the first surface of the backing plate and extends radially between the inner diameter and the outer diameter of the backing plate, wherein the step extends underneath a portion of each of the plurality of vanes such that a gap is defined between the first surface of the backing plate and a portion of each of the vanes proximate a leading edge of each of the vanes, the gap located at least partially axially aft of a leading edge of each of the vanes with respect to a cabin air compressor rotation axis.

2. The cabin air compressor assembly of claim 1, wherein the backing plate further comprises:

a third surface disposed axially aft of the first and second surfaces, wherein the third surface extends radially from the inner diameter to an intermediate diameter positioned radially between the inner diameter and the outer diameter;

a cylindrical surface extending axially from the third surface at the intermediate diameter toward the second surface; and wherein the step shifts a portion of the first surface encompassed by the step axially aft relative a portion of the first surface not encompassed by the step.

3. The cabin air compressor assembly of claim 2, wherein the step is a step-down in the first surface from the outer diameter to the inner diameter.

4. The cabin air compressor assembly of claim 3, wherein the step extends radially on the first surface between the inner diameter and the intermediate diameter.

5. The cabin air compressor assembly of claim 4, wherein the step extends circumferentially around the inner diameter of the backing plate.

6. The cabin air compressor assembly of claim 5, wherein a ratio between a depth (W1) of the step and a width (W2) between the first surface and the second surface is approximately 0.020 to 0.032.

7. The cabin air compressor assembly of claim 6, wherein a ratio between a width (W3) between the first surface and the third surface and the width (W2) between the first surface and the second surface is approximately 2.8 to 3.0.

8. The cabin air compressor assembly of claim 7, wherein a ratio between the width (W3) between the first surface and the third surface and the depth (W1) of the step is approximately 93.333 to 142.500.

9. The cabin air compressor assembly of claim 4, wherein a ratio between a length (D1) of the outer diameter and a length (D2) of the inner diameter is approximately 1.898 to 1.899.

10. The cabin air compressor assembly of claim 9, wherein a ratio between the length (D1) of the outer diameter and a length (D3) of the intermediate diameter is approximately 1.584 to 1.586.

11. The cabin air compressor assembly of claim 10, wherein a ratio between the length (D2) of the inner diameter and the length (D3) of the intermediate diameter is approximately 0.8346 to 0.8352.

12. The cabin air compressor assembly of claim 11, wherein a ratio between the length (D2) of the inner diameter and a diameter (D4) of the step is approximately 0.8449 to 0.8454.

13. The cabin air compressor assembly of claim 1, wherein the first surface of the backing plate comprises a hard anodizing coating.

* * * * *